US008020405B2

(12) United States Patent
Setoguchi et al.

(10) Patent No.: US 8,020,405 B2
(45) Date of Patent: Sep. 20, 2011

(54) AIR CONDITIONING APPARATUS

(75) Inventors: Takayuki Setoguchi, Sakai (JP); Makoto Kojima, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 860 days.

(21) Appl. No.: 12/066,732

(22) PCT Filed: Sep. 15, 2006

(86) PCT No.: PCT/JP2006/318375

§ 371 (c)(1),
(2), (4) Date: Mar. 13, 2008

(87) PCT Pub. No.: WO2007/034744

PCT Pub. Date: Mar. 29, 2007

(65) Prior Publication Data

US 2010/0058800 A1 Mar. 11, 2010

(30) Foreign Application Priority Data

Sep. 20, 2005 (JP) ..... 2005-272377

(51) Int. Cl.
*F25B 41/00* (2006.01)

(52) U.S. Cl. ..... 62/513

(58) Field of Classification Search ..... 62/190, 62/498, 513, 515

See application file for complete search history.

(56) References Cited

U.S. PATENT DOCUMENTS

| | | | | |
|---|---|---|---|---|
| 1,508,519 | A * | 9/1924 | Horne | 73/861.49 |
| 3,850,004 | A * | 11/1974 | Vander Arend | 62/115 |
| 6,581,397 | B1 * | 6/2003 | Taira et al. | 62/199 |

FOREIGN PATENT DOCUMENTS

| | | | |
|---|---|---|---|
| JP | 05-332641 | A | 12/1993 |
| JP | 06-213518 | A | 8/1994 |
| JP | 09-145168 | A | 6/1997 |
| JP | 2001-056188 | A | 2/2001 |
| JP | 2005-098581 | A | 4/2005 |

* cited by examiner

*Primary Examiner* — Melvin Jones
(74) *Attorney, Agent, or Firm* — Global IP Counselors

(57) ABSTRACT

An air conditioning apparatus includes a supercooling heat exchanger configured to exchange heat between a high-pressure refrigerant and a low-pressure refrigerant. A high-pressure liquid refrigerant pipe is wound around an external periphery of a low-pressure refrigerant suction pipe. Preferably, the supercooling heat exchanger is disposed inside the indoor unit at a position below an evaporator. Drain water from the evaporator is dispersed over the supercooling heat exchanger or a drain pipe leading from a drain pan of the evaporator is wound together with the high-pressure liquid refrigerant pipe around the low-pressure refrigerant suction pipe. In either case, cold energy of the drain water effectively acts on the high-pressure liquid refrigerant pipe to exchange heat. The supercooling heat exchanger operates with improved efficiency without any increase in the volume of the heat exchanger so that the evaporator can be made as small and compact as possible.

3 Claims, 4 Drawing Sheets

AIR CONDITIONING APPARATUS

CROSS-REFERENCE TO RELATED APPLICATIONS

This U.S. National stage application claims priority under 35 U.S.C. §119(a) to Japanese Patent Application No. 2005-272377, filed in Japan on Sep. 20, 2005, the entire contents of which are hereby incorporated herein by reference.

TECHNICAL FIELD

The present invention relates to an air conditioning apparatus that uses a supercooling heat exchanger.

BACKGROUND ART

FIG. 6 shows a configuration of an air conditioning apparatus that uses a conventional supercooling heat exchanger.

In this air conditioning apparatus, a compressor 1, a four-way switching valve 2, an outdoor-side heat exchanger 3 that functions as a condenser during the cooling operation and as an evaporator during the heating operation, a heating expansion valve 4, a receiver 5, a cooling expansion valve 6, an indoor-side heat exchanger 8 that functions as an evaporator during the cooling operation and as a condenser during the heating operation, and other components are connected sequentially via the four-way switching valve 2, thereby constituting a refrigerating cycle for air conditioning as is shown in the drawings.

The switching operation of the four-way switching valve 2 allows a refrigerant to be reversibly circulated in the direction shown by solid arrows in the drawing during the cooling operation, and in the direction shown by dashed arrows in the drawing during the heating operation, thereby resulting in cooling and heating, respectively.

The outdoor-side heat exchanger 3 and the indoor-side heat exchanger 8 are both configured to include numerous refrigerant paths. Therefore, even if the capacity of the flow divider portion to distribute the refrigerant is improved to a maximum, it is difficult to distribute the refrigerant evenly throughout the refrigerant paths.

In view of this, when the outdoor-side heat exchanger 3 or the indoor-side heat exchanger 8 functions as the evaporator, the amount of pressure reduction in the heating expansion valve 4 or cooling expansion valve 6 is appropriately set so that the refrigerant of the exit side is in appropriately humidified condition. Thus, maximum performance as the evaporator can be guaranteed, even if, for example, the refrigerant drifts into the outdoor-side heat exchanger 3 or the indoor-side heat exchanger 8, and therefore the evaporator can be made as compact as possible.

The performance of the evaporator can be further improved by removing the refrigerant supercooling of the exit side of the condenser, increasing the difference in enthalpy of the evaporator side to reduce circulating volume, and reducing the pressure loss on the evaporator side. This is accomplished by providing a liquid-gas heat exchanger 9 having a double pipe structure comprising a low-pressure refrigerant suction pipe 16 as an inner pipe and a high-pressure liquid refrigerant pipe 15 as an outer pipe, as a supercooling heat exchanger.

In this liquid-gas heat exchanger 9, e.g., the flow rate of the refrigerant, the length of the double pipes, the inside diameter of the outer pipe, and the outside diameter of the inner pipe are set in a predetermined manner appropriately.

As the liquid-gas heat exchanger 9 is provided in this manner, the refrigerant of the exit side of the evaporator is superheated, and backflow into the compressor 1 can be prevented, and the refrigerant of the exit side of the condenser is supercooled, and the difference in enthalpy of the evaporator side can be increased to reduce circulating volume. Therefore, the pressure loss can also be reduced, and the evaporator 8 (or the evaporator 3) can be made even more compact (see Japanese Laid-open Patent Publication No. 5-332641, specification pages 1-5 and FIGS. 1-5.

SUMMARY OF THE INVENTION

Problems the Invention is Intended to Solve

The inventors of the present application have intended to possibly reduce the size and volume of the supercooling heat exchanger 9 comprising the low-pressure refrigerant suction pipe 16 and the high-pressure liquid refrigerant pipe 15, and to place the supercooling heat exchanger 9 inside the indoor unit 7.

In cases in which the above-described configuration is employed, the piping must be lengthened somewhat, but during cooling, it is possible to allow the cold of the drain water from the evaporator in the indoor unit 7 to act in some form on the high-pressure liquid refrigerant pipe, and to improve heat exchange efficiency during the supercooling.

However, in this case, when considering the case of using the space in the indoor unit 7 to install the supercooling heat exchanger 9, there is inevitably a limit to which the volume of the heat-exchanging part of the supercooling heat exchanger can be enlarged. Therefore, problems are encountered in that the area of the heat-exchanging part cannot be increased in a double pipe structure, and the heat exchange efficiency cannot be raised as such.

The present invention was designed in order to resolve such problems, and an object thereof is to provide an air conditioning apparatus wherein a supercooling heat exchanger is structured with a high-pressure liquid refrigerant pipe wound around the external periphery of a low-pressure refrigerant suction pipe, the supercooling heat exchanger having this structure is disposed at a position below the evaporator in the indoor unit, and either the drain water from the evaporator is dispersed onto the supercooling heat exchanger, or the drain pipe leading from the evaporator drain pan is wound together with the high-pressure liquid refrigerant pipe around the external periphery of the low-pressure refrigerant suction pipe of the supercooling heat exchanger, thereby suitably resolving the aforementioned new problems.

Means for Solving These Problems

To achieve these objects, the present invention is configured including the following means of solving these problems.

(1) Invention of a First Aspect

The problem-solving means of this invention is an air conditioning apparatus comprising a supercooling heat exchanger 9 for exchanging heat between a low-pressure refrigerant and a high-pressure refrigerant, characterized in that the supercooling heat exchanger 9 is configured with a high-pressure liquid refrigerant pipe 15 wound around the external periphery of a low-pressure refrigerant suction pipe 16, and is disposed inside an indoor unit 7.

Thus, when the supercooling heat exchanger 9 is configured with the high-pressure liquid refrigerant pipe 15 wound around the external periphery of the low-pressure refrigerant suction pipe 16, the supercooling heat exchanger 9 can be made as small as possible in size and volume, and can easily be installed inside the indoor unit 7.

As a result, the supercooling heat exchanger is disposed, for example, below the evaporator or the drain pan, the cold of the cooling water from the evaporator or the drain pan can be used to effectively cool the high-pressure liquid refrigerant pipe 15, and the heat exchange efficiency for supercooling can be effectively improved.

(2) Invention of a Second Aspect

The problem-solving means of this invention is an air conditioning apparatus comprising a supercooling heat exchanger 9 for exchanging heat between a low-pressure refrigerant and a high-pressure refrigerant, wherein the supercooling heat exchanger 9 is configured with a high-pressure liquid refrigerant pipe 15 wound around the external periphery of a low-pressure refrigerant suction pipe 16; the air conditioning apparatus characterized in that the supercooling heat exchanger 9 is disposed at a position below an evaporator 8 inside an indoor unit 7, and drain water W from the evaporator 8 is dispersed onto the supercooling heat exchanger 9.

With this type of configuration, the cold of the drain water W from the evaporator 8 can be made to act effectively on the high-pressure liquid refrigerant pipe 15 to conduct heat exchange, and the heat exchange efficiency for supercooling can be effectively improved.

(3) Invention of a Third Aspect

The problem-solving means of this invention is an air conditioning apparatus comprising a supercooling heat exchanger 9 for exchanging heat between a low-pressure refrigerant and a high-pressure refrigerant, wherein the supercooling heat exchanger 9 is configured with a high-pressure liquid refrigerant pipe 15 wound around the external periphery of a low-pressure refrigerant suction pipe 16; the air conditioning apparatus characterized in that the supercooling heat exchanger 9 is disposed at a position below a drain pan 10 of an evaporator 8 in an indoor unit 7, and a drain pipe 11 leading from the drain pan 10 is wound together with the high-pressure liquid refrigerant pipe 15 around the external periphery of the low-pressure refrigerant suction pipe 16 of the supercooling heat exchanger 9.

With this type of configuration, the cold of the drain pipe 11 through which drain water W from the evaporator 8 flows can be made to act effectively on the high-pressure liquid refrigerant pipe 15 to conduct heat exchange, and the heat exchange efficiency for supercooling can be improved even more effectively.

EFFECT OF THE INVENTION

According to the present invention, as a result of the above, the heat exchange performance of the supercooling heat exchanger can be maximally improved, effectively enabling the evaporator to be made smaller and more compact, and the supercooling heat exchanger itself can be made into a size and volume small enough to be disposed inside an indoor unit.

DETAILED DESCRIPTION OF THE INVENTION

Preferred Embodiment 1

Figure 1:
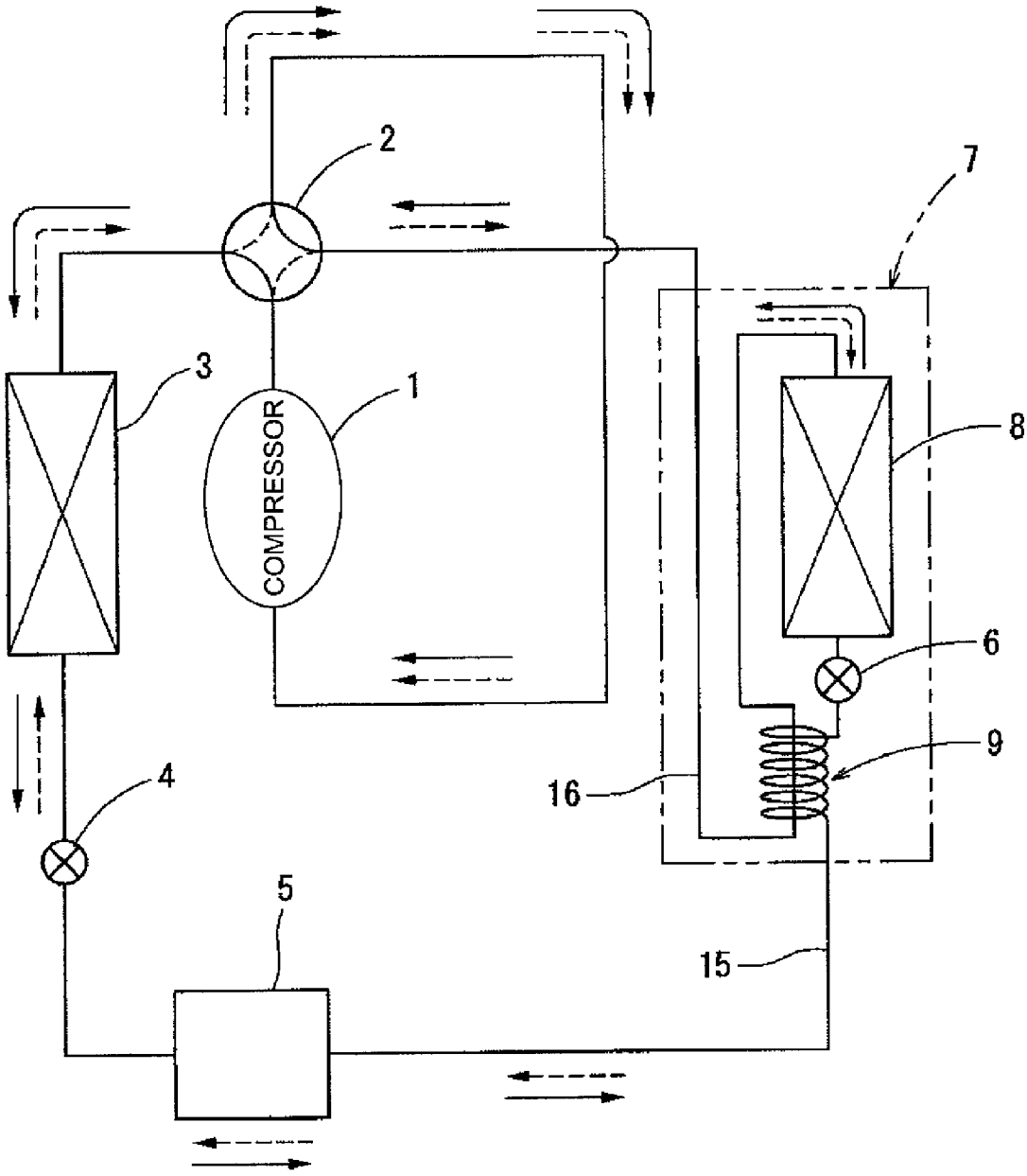
FIG. 1 is a refrigeration circuit diagram showing the configuration of an air conditioning apparatus according to Preferred Embodiment 1 of the present invention.

First, FIG. 1 of the attached drawings shows the configuration of an air conditioning apparatus according to Preferred Embodiment 1 of the present invention.

In the air conditioning apparatus of this embodiment as shown in FIG. 1, a compressor 1, a four-way switching valve 2, an outdoor-side heat exchanger 3 that functions as a condenser during the cooling operation and as an evaporator during the heating operation, a heating expansion valve 4, a receiver 5, a cooling expansion valve 6, an indoor-side heat exchanger 8 that functions as an evaporator during the cooling operation and as a condenser during the heating operation, and other components are connected sequentially via the four-way switching valve 2, thereby constituting a refrigerating cycle for air conditioning as shown in the drawings.

The switching operation of the four-way switching valve 2 allows as much refrigerant as possible to be circulated in the direction shown by the solid arrows in the diagram during the cooling operation, and in the direction shown by the dashed arrows in the diagram during the heating operation, thereby resulting in cooling and heating, respectively.

Figure 6:
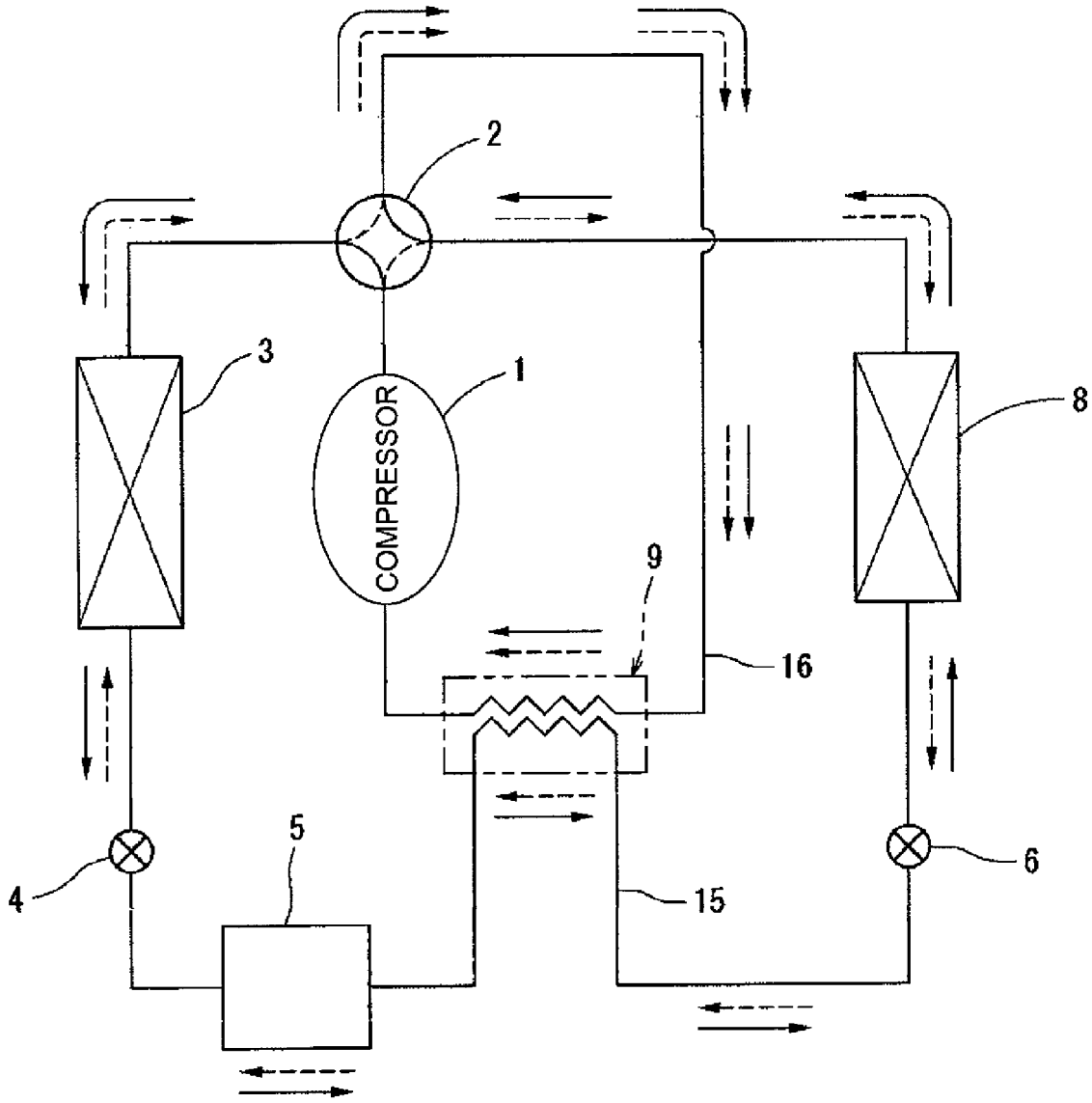
(Prior Art) Fig. 6
FIG. 6 is a refrigerant circuit diagram showing the configuration of a conventional air conditioning apparatus.

A liquid-gas heat exchanger 9 used as a supercooling heat exchanger for exchanging heat between low-pressure refrigerant and high-pressure refrigerant is provided in this embodiment as well as the case in FIG. 6 described previously.

As the liquid-gas heat exchanger 9 is provided in this manner, refrigerant of the exit side of the evaporator is superheated, backflow into the compressor 1 can be prevented, the refrigerant of the exit side of the condenser is supercooled, and the difference in enthalpy of the evaporator side can be increased to reduce refrigerant circulating volume. Therefore, pressure loss can also be reduced, and the indoor-side heat exchanger (evaporator) 8 can be made as compact as possible.

However, in this embodiment, unlike the case in FIG. 6 described previously, the liquid-gas heat exchanger 9 is configured so that inside the main casing of the indoor unit 7, a high-pressure liquid refrigerant pipe 15 smaller in diameter than a low-pressure refrigerant suction pipe 16 is wound in an accordion-like structure (helical structure) around the external periphery of the low-pressure refrigerant suction pipe 16, which leads from the indoor-side heat exchanger (evaporator) 8 back to the compressor 1, as shown in FIG. 1. The liquid-gas heat exchanger 9 is also disposed at a position below the indoor-side heat exchanger (evaporator) 8.

As described specifically in Embodiment 2 below, for example, the configuration is designed so that drain water from the indoor-side heat exchanger (evaporator) 8 is dispersed over the liquid-gas heat exchanger 9 having the accordion-like structure.

With this configuration, the cold energy of the low-temperature drain water can be made to effectively act on the liquid refrigerant inside the high-temperature high-pressure liquid refrigerant pipe 15 to effectively conduct heat exchange (supercooling), and the heat exchange efficiency for supercooling can be effectively improved.

As a result, the heat exchange performance of the supercooling heat exchanger 9 can be improved as much as possible, and effectively enabling the indoor-side heat exchanger (evaporator) 8 to be made smaller and more compact, and the supercooling heat exchanger 9 itself can be made into a size and volume small enough to be disposed inside the indoor unit 7.

Preferred Embodiment 2

Figure 2:
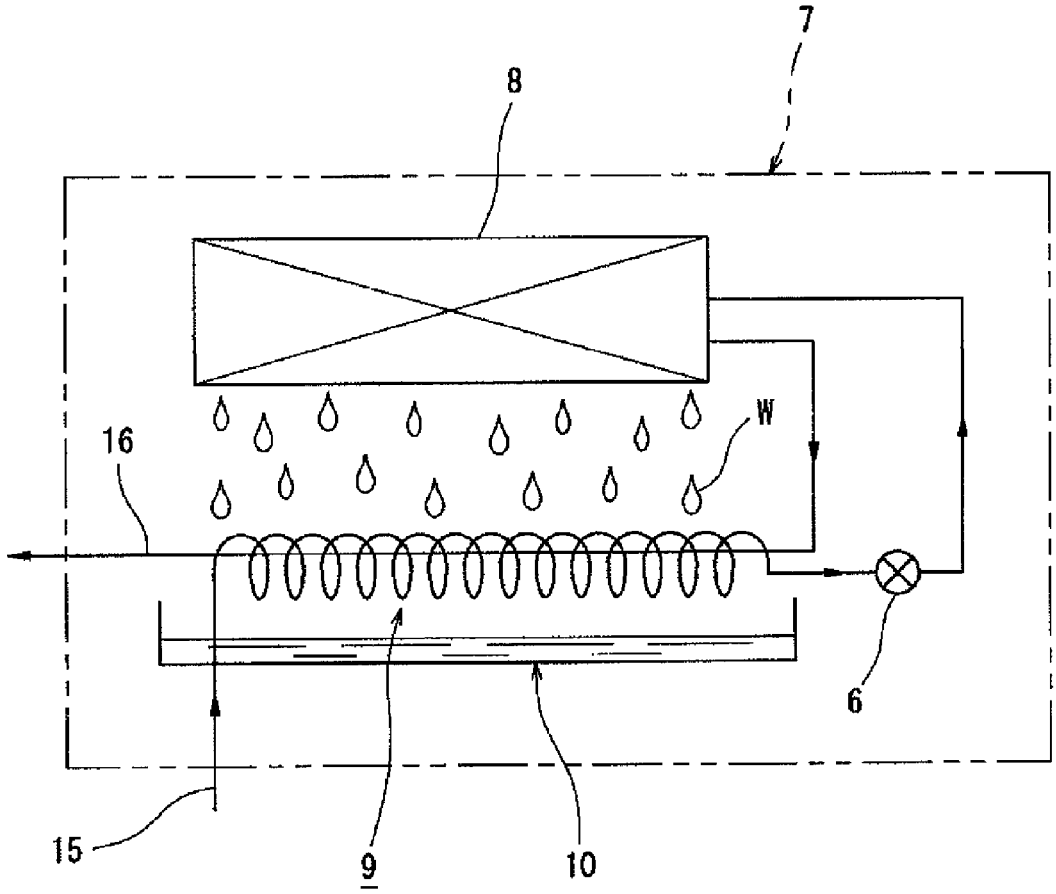
FIG. 2 is a refrigeration circuit diagram showing the configuration of an air conditioning apparatus according to Preferred Embodiment 2 of the present invention.
Figure 3:
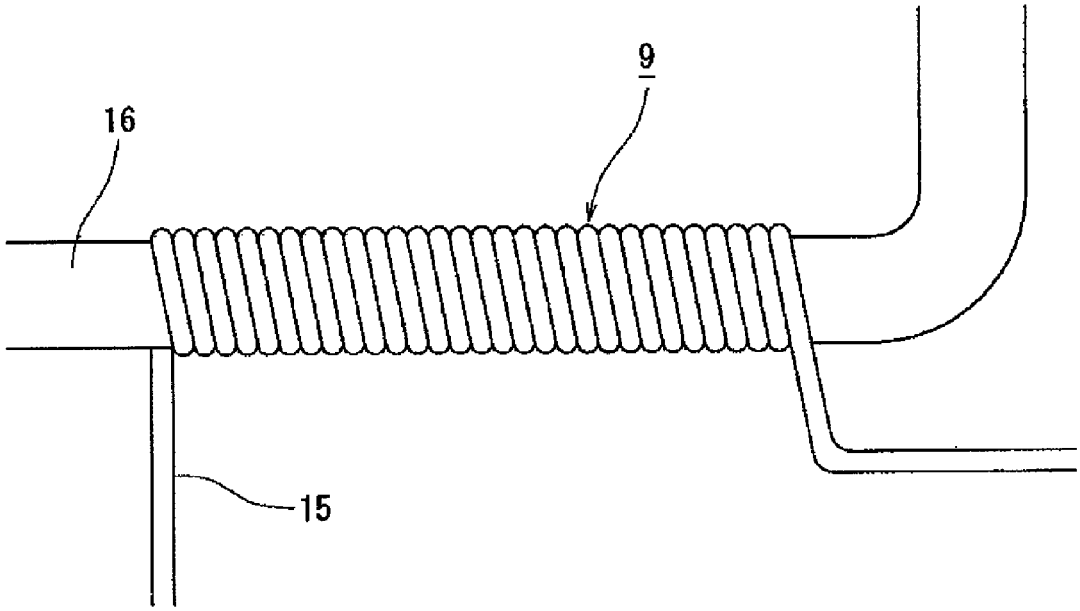
FIG. 3 is an enlarged view showing the detailed configuration of a liquid-gas heat exchanger, which is a relevant part of the same apparatus.

Next, FIG. 2 in the attached drawings shows the configuration of the indoor unit portion of the air conditioning apparatus according to Preferred Embodiment 2 of the present invention, and the attached drawing FIG. 3 shows the configuration of a relevant part of the same indoor unit.

In the air conditioning apparatus of this embodiment as shown in FIG. 1 described previously, a compressor 1, a four-way switching valve 2, an outdoor-side heat exchanger 3 that functions as a condenser during the cooling operation and as an evaporator during the heating operation, a heating expansion valve 4, a receiver 5, a cooling expansion valve 6, an indoor-side heat exchanger 8 that functions as an evaporator during the cooling operation and as a condenser during the heating operation, and other components are connected sequentially via the four-way switching valve 2, thereby constituting a refrigerating cycle for air conditioning as is shown in the diagram.

The switching operation of the four-way switching valve 2 allows as much refrigerant as possible to be circulated in the direction shown by the solid arrows in the diagram during the cooling operation, and in the direction shown by the dashed arrows in the diagram during the heating operation, thereby resulting in cooling and heating, respectively.

A liquid-gas heat exchanger 9 as a supercooling heat exchanger is provided inside the indoor unit 7 in this embodiment as well as the case in FIG. 1 described previously.

As the liquid-gas heat exchanger 9 is provided in this manner, a refrigerant of the exit side of the evaporator is superheated, backflow into the compressor 1 can be prevented, a refrigerant of the exit side of the condenser is supercooled, and the difference in enthalpy of the evaporator side can be increased to reduce the amount of the refrigerant circulated. Therefore, the pressure loss can also be reduced, and the indoor-side heat exchanger (evaporator) 8 can be made as compact as possible.

Moreover, in this embodiment, the liquid-gas heat exchanger 9 is configured so that the high-pressure liquid refrigerant pipe 15 that is smaller in diameter than the low-pressure refrigerant suction pipe 16 is wound in an accordion-like structure (helical structure) around the external periphery of the low-pressure refrigerant suction pipe 16, which leads from the evaporator back to the compressor 1, as shown in detail in FIGS. 2 and 3, for example. The liquid-gas heat exchanger 9 is also disposed at a position below the indoor-side heat exchanger (the evaporator during cooling) 8, and the drain water W from the indoor-side heat exchanger (evaporator) 8 is dispersed over the liquid-gas heat exchanger 9 having the accordion-like structure.

With this configuration, the cold energy of the low-temperature drain water W can be made to effectively act on the liquid refrigerant inside the high-temperature high-pressure liquid refrigerant pipe 15 to effectively conduct heat exchange (supercooling), and the heat exchange efficiency for supercooling can be effectively improved.

As a result, the heat exchange performance of the supercooling heat exchanger 9 can be improved as much as possible, thereby effectively enabling the indoor-side heat exchanger (evaporator) 8 to be made smaller and more compact, and the supercooling heat exchanger 9 itself can be made into a size and volume small enough to be disposed inside the indoor unit 7.

Preferred Embodiment 3

Figure 4:
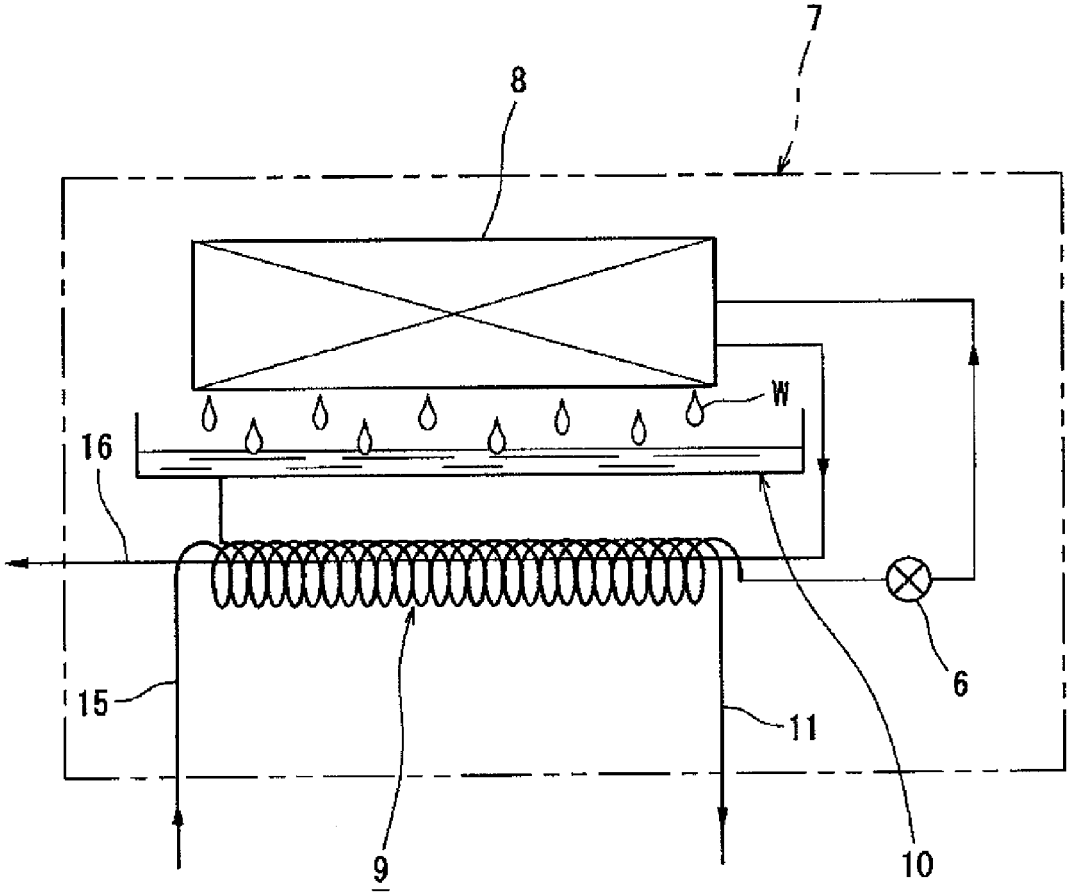
FIG. 4 is a refrigeration circuit diagram showing the configuration of an air conditioning apparatus according to Preferred Embodiment 3 of the present invention.
Figure 5:
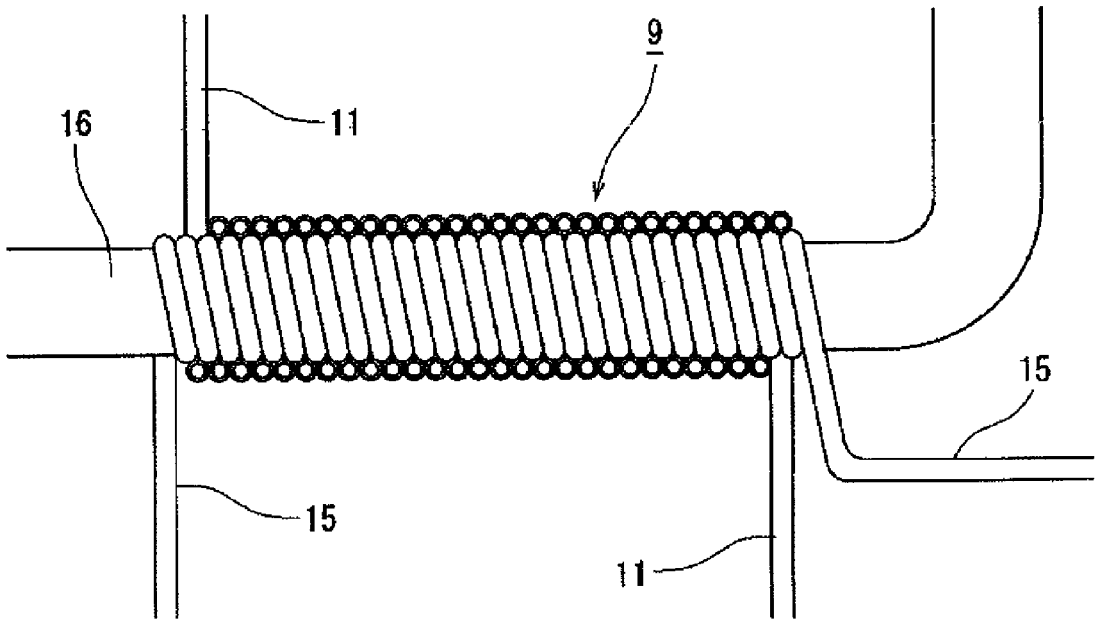
FIG. 5 is an enlarged view showing the detailed configuration of a liquid-gas heat exchanger, which is a relevant part of the same apparatus.

Next, FIG. 4 in the attached drawings shows the configuration of the indoor unit portion of the air conditioning apparatus according to Preferred Embodiment 3 of the present invention, and the attached drawing FIG. 5 shows the configuration of a relevant part of the same indoor unit.

In the air conditioning apparatus of this embodiment as shown in FIG. 1 described previously, a compressor 1, a four-way switching valve 2, an outdoor-side heat exchanger 3 that functions as a condenser during the cooling operation and as an evaporator during the heating operation, a heating expansion valve 4, a receiver 5, a cooling expansion valve 6, an indoor-side heat exchanger 8 that functions as an evaporator during the cooling operation and as a condenser during the heating operation, and other components are connected sequentially via the four-way switching valve 2, thereby constituting a refrigerating cycle for air conditioning.

The switching operation of the four-way switching valve 2 allows the refrigerant to be reversibly circulated in the direction shown by the solid arrows in FIG. 1 during the cooling operation, and in the direction shown by the dashed arrows in FIG. 1 during the heating operation, thereby resulting in cooling and heating, respectively.

A liquid-gas heat exchanger 9 as a supercooling heat exchanger is installed at a position in the indoor unit 7 in this embodiment as well as the cases in Embodiments 1 and 2 described previously. This liquid-gas heat exchanger 9 functions as a supercooling heat exchanger for exchanging heat between a low-pressure gas refrigerant flowing through the low-pressure refrigerant suction pipe 16, and a high-pressure liquid refrigerant flowing through the high-pressure liquid refrigerant pipe 15.

As the liquid-gas heat exchanger 9 is provided in this manner, refrigerant of the exit side of the evaporator is superheated, backflow into the compressor 1 can be prevented, refrigerant of the exit side of the condenser is supercooled, and the difference in enthalpy of the evaporator side can be increased to reduce the amount of the refrigerant circulated. Therefore, the pressure loss can also be reduced, and the indoor-side heat exchanger (evaporator) 8 can be made as compact as possible.

Moreover, the liquid-gas heat exchanger 9 is configured so that the high-pressure liquid refrigerant pipe 15 that is smaller in diameter than the low-pressure refrigerant suction pipe 16 is wound in an accordion-like structure (helical structure) around the external periphery of the low-pressure refrigerant suction pipe 16, as shown in detail in FIGS. 4 and 5. The liquid-gas heat exchanger 9 is also disposed at a position below the drain pan 10 of the indoor-side heat exchanger (evaporator) 8, and the drain pipe 11 leading from the drain pan 10 is then wound in an accordion-like structure (double-helix structure) around the external periphery of the accordion-like high-pressure liquid refrigerant pipe 15 of the liquid-gas heat exchanger 9.

With this configuration, the cold of the accordion-like drain pipe 11 through which low-temperature drain water W flows can be made to effectively act on the liquid refrigerant inside the high-temperature high-pressure liquid refrigerant pipe 15 having a similar accordion-like structure to effectively conduct heat exchange (supercooling), and the heat exchange efficiency for supercooling can be effectively improved.

As a result, the heat exchange performance of the supercooling heat exchanger 9 can be improved as much as possible, thereby effectively enabling the indoor-side heat exchanger (evaporator) 8 to be made smaller and more compact, and the supercooling heat exchanger 9 itself can be made into a size and volume small enough to be disposed inside the indoor unit 7.

INDUSTRIAL APPLICABILITY

The present invention can be widely utilized within the field of air conditioning apparatuses that use supercooling heat exchangers.

What is claimed is:

1. An air conditioning apparatus comprising:

a supercooling heat exchanger arranged to exchange heat between a low-pressure refrigerant and a high-pressure refrigerant, the supercooling heat exchanger having a high-pressure liquid refrigerant pipe wound around an external periphery of a low-pressure refrigerant suction pipe, and the supercooling heat exchanger being disposed within an indoor unit.

2. An air conditioning apparatus comprising:

a supercooling heat exchanger arranged to exchange heat between a low-pressure refrigerant and a high-pressure refrigerant, the supercooling heat exchanger having a high-pressure liquid refrigerant pipe wound around an external periphery of a low-pressure refrigerant suction pipe, the supercooling heat exchanger being disposed at a position below an evaporator inside an indoor unit such that drain water from the evaporator is dispersed onto the supercooling heat exchanger.

3. An air conditioning apparatus comprising:

a supercooling heat exchanger arranged to exchange heat between a low-pressure refrigerant and a high-pressure refrigerant, the supercooling heat exchanger having a high-pressure liquid refrigerant pipe wound around an external periphery of a low-pressure refrigerant suction pipe, the supercooling heat exchanger being disposed at a position below a drain pan of an evaporator in an indoor unit with a drain pipe leading from the drain pan being wound with the high-pressure liquid refrigerant pipe around the external periphery of the low-pressure refrigerant suction pipe of the supercooling heat exchanger.

* * * * *